US008547072B2

(12) United States Patent
Obatake

(10) Patent No.: US 8,547,072 B2
(45) Date of Patent: Oct. 1, 2013

(54) PHASE CONTROL APPARATUS

(75) Inventor: Takayoshi Obatake, Nishinomiya (JP)

(73) Assignee: Maeda Metal Industries, Ltd., Osaka (JP)

( * ) Notice: Subject to any disclaimer, the term of this patent is extended or adjusted under 35 U.S.C. 154(b) by 409 days.

(21) Appl. No.: 13/098,802

(22) Filed: May 2, 2011

(65) Prior Publication Data

US 2011/0279099 A1 Nov. 17, 2011

(30) Foreign Application Priority Data

May 12, 2010 (JP) ..... 2010-109908

(51) Int. Cl.
*G05F 1/00* (2006.01)

(52) U.S. Cl.
USPC ..... 323/212; 323/217; 323/219; 323/259; 323/260; 318/807; 318/809; 318/810; 257/925

(58) Field of Classification Search
USPC ..... 323/212, 217, 219, 259, 260; 318/807, 318/809, 810; 363/21.06, 21.14, 37, 38, 363/44, 48, 58, 108, 114, 88; 257/925
See application file for complete search history.

(56) References Cited

U.S. PATENT DOCUMENTS 3,987,356 A * 10/1976 Steigerwald ..... 363/44
4,528,494 A 7/1985 Bloomer
4,567,425 A 1/1986 Bloomer
5,004,969 A 4/1991 Schanin
5,239,255 A 8/1993 Schanin et al.
6,269,012 B1 7/2001 Kusakabe et al.
2003/0197995 A1 10/2003 Hua et al.
2004/0263088 A1 12/2004 Mukai et al.

FOREIGN PATENT DOCUMENTS

JP 08-154392 6/1996
JP 11-161346 6/1999
JP 2009-012149 A 1/2009
WO 2007/005651 A2 1/2007

OTHER PUBLICATIONS

European Patent Office, "Extended European Search Report", Sep. 14, 2011.

* cited by examiner

*Primary Examiner* — Nguyen Tran
*Assistant Examiner* — Afework Demisse
(74) *Attorney, Agent, or Firm* — Eckert Seamans Cherin & Mellott, LLC; Kirk D. Houser

(57) ABSTRACT

A phase control apparatus includes a first transistor whose source or emitter is connected to one end of an AC power supply and whose drain or collector is connected to one end of a load, a second transistor whose source or emitter is connected to the other end of the AC supply and whose drain or collector is connected to the other end of the load, a diode bridge that rectifies an AC voltage of the AC supply, and a parallel circuit of a zener diode and a capacitor. The parallel circuit generates a high potential relative to a bridge negative output terminal potential, or generates a low potential relative to a bridge positive output terminal potential. First and second transistor control terminal potentials are switched between the high and the bridge negative output terminal potentials, or between the low and the bridge positive output terminal potentials.

10 Claims, 4 Drawing Sheets

PHASE CONTROL APPARATUS

This application claims priority from Japanese Patent Application No. 2010-109908, filed May 12, 2010, which is hereby incorporated by reference herein.

FIELD OF THE INVENTION

The present invention relates to a phase control apparatus for performing phase-control or reverse phase control of power to an AC load, and more specifically to a phase control apparatus for performing phase-control or reverse phase control of power to an AC load, using a transistor as a switching element.

BACKGROUND OF THE INVENTION

In the field of electrical devices such as electric power tools and light fittings, phase control or reverse phase control of power to a load such as an AC (Alternating Current) motor or lighting load is widely performed. For example, JP 2009-12149A and JP 08-154392A disclose control apparatuses for an electric power tool or an AC motor that perform phase control of an AC motor, using a triac or an SSR (Solid State Relay) as a switching element.

In the case where phase control or reverse phase control of an AC load is performed in an electrical device, electromagnetic noise arises due to the sudden change in current at the time of switching. With an electrical device such an electric power tool in which current flow to the AC load is high, the adverse effects on surrounding electrical devices and the human body because of the considerable amounts of electromagnetic noise caused by switching is of particular concern.

JP 11-161346A discloses a phase control apparatus for performing phase control or reverse phase control using two MOSFETs (Metal-Oxide Semiconductor Field-Effect Transistors) connected in series in opposite directions. In recent years, transistors capable of controlling high current such as MOSFETs and IGBTs (Insulated Gate Bipolar Transistors) have become popular in the power electronics field. Compared with triacs and SSRs, transistors are advantageous in reducing the change in current at the time of switching. Hence, even with phase control or reverse phase control of electrical devices (e.g., electric power tools) in which a comparatively high current flows to the load, suppression of electromagnetic noise at the time of switching is conceivable by using a transistor capable of controlling high current as a switching element.

In the case where phase control or reverse phase control using a transistor capable of controlling high current is performed in an electrical device that operates at high current, a comparatively high constant voltage used as a gate or base drive voltage of the transistor needs to be generated and applied to the gate or base of the transistor. A phase control apparatus shown in FIG. 2 of JP 11-161346A uses a gate power supply that uses a transformer to obtain a gate drive voltage from an AC voltage. However, such a gate power supply unit is not preferable in terms of requiring a comparatively large installation area and being costly and heavy.

Also, with a phase control apparatus shown in FIG. 8 of JP 11-161346A, a series circuit of the AC power supply and the load is connected between input terminals of a diode bridge, although full-wave rectifying an AC voltage applied between these terminals with a diode bridge does not allow a stable high DC (Direct Current) voltage to be obtained. Hence, the configuration of this phase control apparatus is not preferable for phase control or reverse phase control using a transistor capable of controlling high current.

If the gate or base drive voltage of a transistor is generated from an AC voltage using half-wave rectification rather than full-wave rectification, it should be possible to generate the gate or base drive voltage using a comparatively simple circuit configuration. However, in order to perform phase control or reverse phase control stably and accurately, the gate or base drive voltage needs to be stable. In view of this, the gate or base drive voltage preferably is generated by full-wave rectifying an AC voltage.

SUMMARY OF THE INVENTION

The present invention is intended to solve the above problems, and has as its object to generate a drive voltage to be applied to a control terminal of a transistor by performing full-wave rectification using a simple circuit configuration that is space saving, low cost and lightweight, in a phase control apparatus for performing phase control or reverse phase control on an AC load using a transistor.

A phase control apparatus of a first aspect of the present invention performs phase-control or reverse phase control of power that is supplied to a load connected to an alternating current power supply, and includes a first transistor whose source or emitter is connected to one end of the alternating current power supply, and whose drain or collector is connected to one end of the load, a second transistor whose source or emitter is connected to the other end of the alternating current power supply, and whose drain or collector is connected to the other end of the load, a diode bridge that rectifies an alternating current voltage of the alternating current power supply, and a parallel circuit of a zener diode and a capacitor. The parallel circuit generates a high potential relative to a potential at a negative output terminal of the diode bridge, or generates a low potential relative to a potential at a positive output terminal of the diode bridge, using an output of the diode bridge, and a potential at a control terminal of the first transistor and a potential at a control terminal of the second transistor are switched between the high potential and the potential at the negative output terminal of the diode bridge or between the low potential and the potential at the positive output terminal of the diode bridge.

Further, the phase control apparatus of the present invention includes a resistor. One end of the resistor is connected to the positive output terminal of the diode bridge, the other end of the resistor is connected to a cathode of the zener diode and one end of the capacitor, and an anode of the zener diode and the other end of the capacitor are connected to the negative output terminal of the diode bridge. One input terminal of the diode bridge is connected to a connection point of the alternating current power supply and the first transistor, and the other input terminal of the diode bridge is connected to a connection point of the alternating current power supply and the second transistor. Also, the potential at the control terminal of the first transistor and the potential at the control terminal of the second transistor are switched between a potential at a connection point of the resistor and the parallel circuit and the potential at the negative output terminal of the diode bridge.

Further, the phase control apparatus of the present invention includes a switching element. The control terminal of the first transistor and the control terminal of the second transistor are each connected to one end of the switching element via a gate resistor, and a potential at one end of the switching element switches between the potential at the connection point of the resistor and the parallel circuit and the potential at the negative output terminal of the diode bridge, according to an on/off state of the switching element.

Further, the phase control apparatus of the present invention includes a resistor. One end of the resistor is connected to the negative output terminal of the diode bridge, the other end of the resistor is connected to an anode of the zener diode and one end of the capacitor, and a cathode of the zener diode and the other end of the capacitor are connected to the positive output terminal of the diode bridge. One input terminal of the diode bridge is connected to a connection point of the alternating current power supply and the first transistor, and the other input terminal of the diode bridge is connected to a connection point of the alternating current power supply and the second transistor. Also, the potential at the control terminal of the first transistor and the potential at the control terminal of the second transistor are switched between a potential at the connection point of the resistor and the parallel circuit and a potential at the positive output terminal of the diode bridge.

Further, the phase control apparatus of the present invention includes a switching element. The control terminal of the first transistor and the control terminal of the second transistor are each connected to one end of the switching element via a gate resistor, and a potential at one end of the switching element switches between the potential at the connection point of the resistor and the parallel circuit and the potential at the positive output terminal of the diode bridge, according to an on/off state of the switching element.

A phase control apparatus of a second aspect of the present invention performs phase-control or reverse phase control of power that is supplied to a load connected to an alternating current power supply, using a switching means provided in series with the load, and includes a diode bridge that rectifies an alternating current voltage of the alternating current power supply, a first parallel circuit of a first zener diode and a first capacitor for generating a high potential relative to a potential at a negative output terminal of the diode bridge, using an output of the diode bridge, and a second parallel circuit of a second zener diode and a second capacitor for generating a low potential relative to a potential at a positive output terminal of the diode bridge, using the output of the diode bridge. The switching means includes a first transistor provided between the alternating current power supply and the load, a second transistor of different polarity to the first transistor and arranged in parallel with the first transistor, a first diode connected in series in the forward direction with respect to the first transistor, and a second diode connected in series in the forward direction with respect to the second transistor. A source or an emitter of the first transistor and a source or an emitter of the second transistor are arranged on the alternating current power supply side, a potential at a control terminal of the first transistor is switched between the high potential and the potential at the negative output terminal of the diode bridge, and a potential at a control terminal of the second transistor is switched between the low potential and the potential at the positive output terminal of the diode bridge.

Further, the phase control apparatus of the present invention includes a resistor. One end of the resistor is connected to a cathode of the first zener diode and one end of the first capacitor, the other end of the resistor is connected to an anode of the second zener diode and one end of the second capacitor, an anode of the first zener diode and the other end of the first capacitor are connected to the negative output terminal of the diode bridge, and a cathode of the second zener diode and the other end of the second capacitor are connected to the positive output terminal of the diode bridge. One input terminal of the diode bridge is connected to a connection point of the alternating current power supply and the switching means, and the other input terminal of the diode bridge is connected to a connection point of the alternating current power supply and the load. Also, the potential at the control terminal of the first transistor is switched between a potential at a connection point of the resistor and the first parallel circuit and the potential at the negative output terminal of the diode bridge, and the potential at the control terminal of the second transistor is switched between a potential at a connection point of the resistor and the second parallel circuit and the potential at the positive output terminal of the diode bridge.

Further, the phase control apparatus of the present invention includes a first switching element and a second switching element. The control terminal of the first transistor is connected to one end of the first switching element via a gate resistor, a potential at one end of the first switching element switches between the potential at the connection point of the resistor and the first parallel circuit and the potential at the negative output terminal of the diode bridge, according to an on/off state of the first switching element, the control terminal of the second transistor is connected to one end of the second switching element via a gate resistor, and a potential at one end of the second switching element switches between the potential at the connection point of the resistor and the second parallel circuit and the potential at the positive output terminal of the diode bridge, according to an on/off state of the second switching element.

Further, the phase control apparatus of the present invention includes a first resistor and a second resistor. One end of the first resistor is connected to a cathode of the first zener diode and one end of the first capacitor, one end of the second resistor is connected to an anode of the second zener diode and one end of the second capacitor, the other end of second resistor, an anode of the first zener diode and the other end of the first capacitor are connected to the negative output terminal of the diode bridge, and the other end of first resistor, a cathode of the second zener diode and the other end of the second capacitor are connected to the positive output terminal of the diode bridge. One input terminal of the diode bridge is connected to a connection point of the alternating current power supply and the switching means, and the other input terminal of the diode bridge is connected to a connection point of the alternating current power supply and the load. Also, the potential at the control terminal of the first transistor is switched between a potential at a connection point of the first resistor and the first parallel circuit and the potential at the negative output terminal of the diode bridge, and the potential at the control terminal of the second transistor is switched between a potential at a connection point of the second resistor and the second parallel circuit and the potential at the positive output terminal of the diode bridge.

Further, the phase control apparatus of the present invention includes a first switching element and a second switching element. The control terminal of the first transistor is connected to one end of the first switching element via a gate resistor, a potential at one end of the first switching element switches between the potential at the connection point of the first resistor and the first parallel circuit and the potential at the negative output terminal of the diode bridge, according to an on/off state of the first switching element, the control terminal of the second transistor is connected to one end of the second switching element via a gate resistor, and a potential at one end of the second switching element switches between the potential at the connection point of the second resistor and the second parallel circuit and the potential at the positive output terminal of the diode bridge, according to an on/off state of the second switching element.

In the present invention, a potential applied to the control terminal of two transistors used in phase control or reverse phase control is provided using the abovementioned circuit configuration. Further, these transistors are arranged such that the relationship between the potential at the source or emitter of the two transistors and the potential at the output terminal of the diode bridge changes according to the AC voltage. Hence, with the present invention, full-wave rectification can be performed using a simple circuit configuration that is space saving, low cost and lightweight, and, further, by performing full-wave rectification using this circuit configuration, a stable voltage required for controlling these transistors can be provided to control terminals of the two transistors. This circuit configuration is space saving, low cost, lightweight and simple, given that electrical components such as transformers are not included.

Also, because a sufficiently high voltage can be generated in the case where a commercial AC power supply is used as the AC power supply, for example, phase control or reverse phase control using a high current transistor as the switching element can be readily performed in the present invention.

DETAILED DESCRIPTION OF THE INVENTION

Hereinafter, the present invention will be described using the drawings.

Figure 1:
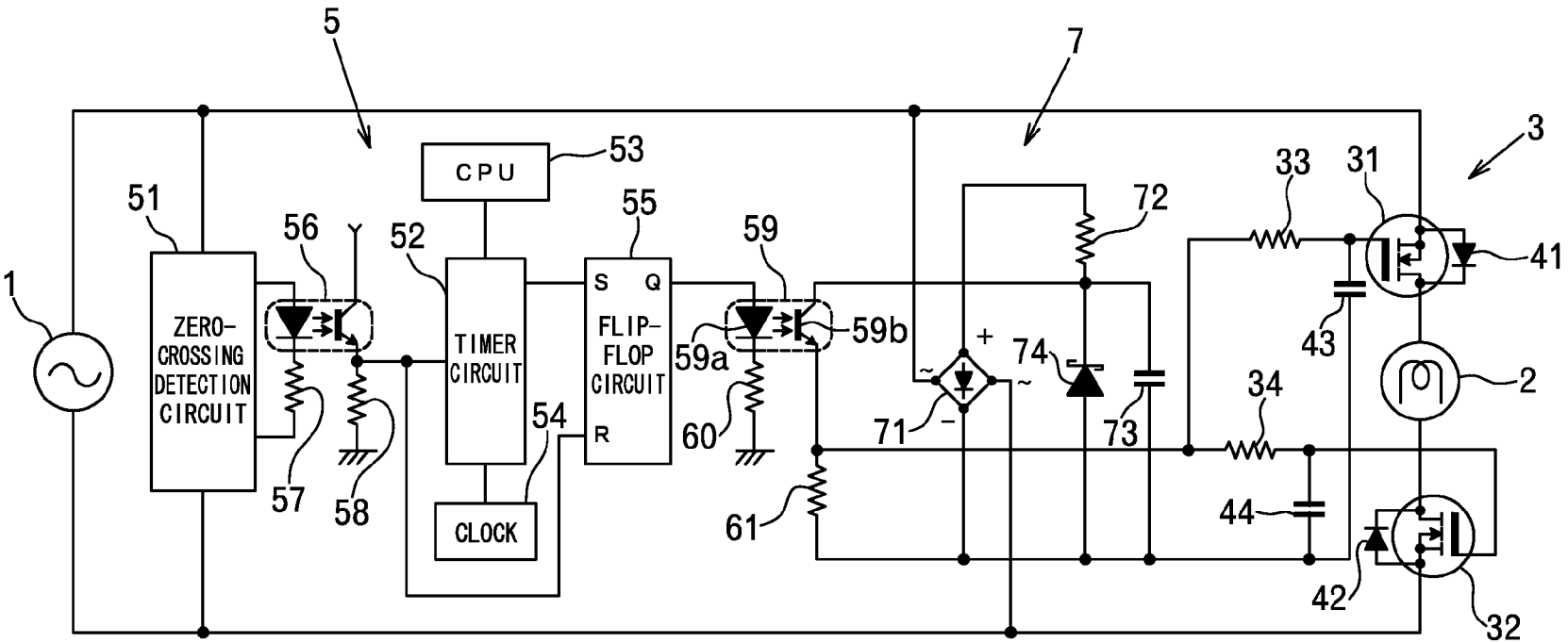
FIG. 1 is a circuit diagram showing a first embodiment of a phase control apparatus of the present invention.

FIG. 1 is a circuit diagram showing a configuration of a phase control apparatus serving as a first embodiment of the present invention. The phase control apparatus is provided with an AC load 2 whose power supply is an AC power supply 1, a switching means 3 that switches supply power to the AC load 2 on/off, a control means 5 that controls the operation of the switching means 3 such that a voltage is applied to the AC load 2 at a prescribed phase angle or firing angle, and a constant voltage generation means 7 that generates a constant voltage to be used in controlling the switching means 3 from an AC voltage.

For example, the AC power supply 1 is a commercial AC power supply of a single-phase alternating current, and a 100 V, 50 or 60 Hz single-phase AC power supply, a 220 V, 50 Hz single-phase AC power supply or the like may be used. For example, a phase control apparatus of the present invention is incorporated and used in a bolt tightening device, and the AC load 2 is an AC motor that rotationally drives a socket. The socket detachably engages the head of a bolt or a nut that is threaded onto a bolt. The electrical device in which the phase control apparatus of the present invention is used is not particularly limited, and the phase control apparatus of the present invention may be applied to an electrical device other than a bolt tightening device. For example, the phase control apparatus of the present invention may be used in order to perform phase control of a lighting load in a light fitting.

The switching means 3 includes two N-channel MOSFETs 31 and 32 connected in series to the AC load 2. The drain of the MOSFET 31 is connected to one end of the AC load 2, and the source of the MOSFET 31 is connected to one end of the AC power supply 1. The drain of the MOSFET 32 is connected to the other end of the AC load 2, and the source of the MOSFET 32 is connected to the other end of the AC power supply 1. A diode 41 that allows reverse current flow is provided between the drain and source of the MOSFET 31. A diode 42 that allows reverse current flow is also provided between the drain and source of the MOSFET 32. The operation of the switching means 3 will be discussed in detail later.

The control means 5 includes a zero-crossing detection circuit 51, a timer circuit 52, a CPU 53, a clock 54, and a flip-flop circuit 55. A series circuit composed of a light-emitting diode of a first photocoupler 56 and a resistor 57 is connected between output terminals of the zero-crossing detection circuit 51. The collector of a phototransistor of the first photocoupler 56 is connected to an unshown power supply, and the emitter of this phototransistor is connected to an input terminal of the timer circuit 52 and a reset terminal of the flip-flop circuit 55, as well as being grounded via a resistor 58. The AC voltage of the AC power supply 1 is applied between input terminals of the zero-crossing detection circuit 51. The zero-crossing detection circuit 51 detects a state in which the AC voltage of the AC power supply 1 is zero, that is, zero crossing of the AC voltage, and generates a signal having short pulses according to zero crossings of the AC voltage. The pulse interval of the signal is a half cycle of the AC voltage. The generated pulse signal is input to the timer circuit 52 and the flip-flop circuit 55 via the first photocoupler 56.

The timer circuit 52 starts counting time whenever a pulse output from the zero-crossing detection circuit 51 is received. When a prescribed set time period has been counted, the timer circuit 52 outputs a pulse to a set terminal of the flip-flop circuit 55. In other words, the timer circuit 52 outputs the pulse signal output by the zero-crossing detection circuit 51 to the flip-flop circuit 55 after delaying the pulse signal by this set time period.

The clock 54 generates a clock signal that is used by the timer circuit 52 in counting time. The CPU 53 sets the above set time period, that is, the delay time period of the pulse signal, and provides the set time period to the timer circuit 52. For example, in the case where the phase control apparatus of the present invention is used in a bolt tightening device, the CPU 53 determines the set time period according to a tightening torque setting that has been set by a user, and provides the set time period to the timer circuit 52.

The pulse signal output by the zero-crossing detection circuit 51 is input to the reset terminal of the flip-flop circuit 55, and to the set terminal of the flip-flop circuit 55 after being delayed by the set time period. The flip-flop circuit 55 in FIG. 1 is reset by input of the pulse to the reset terminal, and is set when the pulse is input to the set terminal after the set time period has elapsed from input of the pulse to the reset terminal. As a result, the flip-flop circuit 55 generates a pulse signal whose pulse interval is a half-cycle of the alternating current, and whose pulse width is a time period obtained by subtracting the set time period from the half-cycle of the alternating current. The pulse width of each pulse of this pulse signal corresponds to the phase angle of phase control.

An output terminal of the flip-flop circuit 55 is grounded via a light-emitting diode 59*a* of a second photocoupler 59 and a resistor 60. The collector of a phototransistor 59*b* of the second photocoupler 59 is connected to a power supply line that supplies the constant voltage generated by the constant voltage generation means 7. The emitter of the phototransistor 59*b* of the second photocoupler 59 is connected to the respective gates of the MOSFETs 31 and 32 via gate resistors 33 and 34.

The constant voltage generation means 7 is provided with a diode bridge 71 that full-wave rectifies the AC voltage. One input terminal of the diode bridge 71 is connected to a connection point of the MOSFET 31 and the AC power supply 1, and the other input terminal of the diode bridge 71 is connected to a connection point of the MOSFET 32 and the AC power supply 1. A positive output terminal of the diode bridge 71 is connected to a parallel circuit of a capacitor 73 and a zener diode 74 via a resistor 72. One end of the capacitor 73 and the cathode of the zener diode 74 are connected to one end of the resistor 72. The other end of the capacitor 73 and the anode of the zener diode 74 are connected to a negative output terminal of the diode bridge 71. The emitter of the phototransistor 59*b* of the second photocoupler 59 of the control means 5 is also connected to the negative output terminal of the diode bridge 71 via a resistor 61.

The diode bridge 71 of the constant voltage generation means 7 full-wave rectifies the AC voltage of the AC power supply 1, and the capacitor 73 smoothes the rectified DC voltage. As a result of the zener diode 74 providing an upper limit on the smoothed DC voltage, a potential (hereinafter, "supply potential") at a connection point of the resistor 72 and the parallel circuit of the capacitor 73 and the zener diode 74 is substantially constant relative to a potential (hereinafter, "reference potential") at the negative output terminal of the diode bridge 71. The voltage at this connection point relative to the negative output terminal of the diode bridge 71 is the constant voltage generated by the constant voltage generation means 7.

If the pulse signal output from the flip-flop circuit 55 of the control means 5 is high, the phototransistor 59*b* of the second photocoupler 59 is turned on by light from the light-emitting diode 59*a* of the second photocoupler 59. The potential at the gates of the MOSFETs 31 and 32 thus changes to the supply potential. If the pulse signal output from the flip-flop circuit 55 is low, the phototransistor 59*b* of the second photocoupler 59 is turned off, and the potential at the gates of the MOSFETs 31 and 32 changes to the reference potential.

Consider the case where the phototransistor 59*b* of the second photocoupler 59 is turned on, and the potential at the gates of the MOSFETs 31 and 32 changes to the supply potential, under conditions where the potential at the source of the MOSFET 31 is higher than the potential at the source of the MOSFET 32. In this case, given that the potential at the source of the MOSFET 32 is substantially the same as the reference potential (potential at the negative output terminal of the diode bridge 71), the supply potential of the constant voltage generation means 7 (difference between this supply potential and the reference potential) is applied to the gate of the MOSFET 32 as the gate drive voltage of the MOSFET 32. The MOSFET 32 is thus turned on. As a result of the MOSFET 32 being turned on, current flows through the diode 41, the AC load 2 and the drain and source of the MOSFET 32 (i.e., circuit composed of the AC load 2 and the switching means 3 has continuity), irrespective of whether the MOSFET 31 is on or off, and power is supplied to the AC load 2. If a parasitic diode of the MOSFET 31 can be utilized in place of the diode 41, the diode 41 need not be provided.

Consider the case where the phototransistor 59*b* of the second photocoupler 59 is turned on, and the potential at the gates of the MOSFETs 31 and 32 changes to the supply potential, under conditions where the potential at the source of the MOSFET 32 is higher than the potential at the source of the MOSFET 31. In this case, given that the potential at the source of the MOSFET 31 is substantially the same as the reference potential, the supply potential of the constant voltage generation means 7 is applied to the gate of the MOSFET 31 as the gate drive voltage of the MOSFET 31. The MOSFET 31 is thus turned on. As a result of the MOSFET 31 being turned on, current flows through the diode 42, the AC load 2 and the drain and source of the MOSFET 31 (i.e., circuit composed of the AC load 2 and the switching means 3 has continuity), irrespective of whether the MOSFET 32 is on or off, and power is supplied to the AC load 2. If a parasitic diode of the MOSFET 32 can be utilized in place of the diode 42, the diode 42 need not be provided.

In the case where the phototransistor 59*b* of the second photocoupler 59 is turned on, and the potential at the gates of the MOSFETs 31 and 32 changes to the supply potential, under conditions where the potential at the source of the MOSFET 31 and the potential at the source of the MOSFET 32 are equal or substantially equal, the MOSFETs 31 and 32 are both turned on. The circuit composed of the AC load 2 and the switching means 3 thus has continuity. Even when the MOSFET on the high potential side is turned off following a subsequent change in the AC voltage, current flows to the diode set in parallel in that MOSFET, and the MOSFET on the low potential side is in the on-state. Hence, the circuit composed of the AC load 2 and the switching means 3 continues to have continuity, and power is supplied to the AC load 2.

Consider the case where the phototransistor 59*b* of the second photocoupler 59 is turned off, and the gates of the MOSFETs 31 and 32 change to the reference potential, under conditions where the potential at the source of the MOSFET 31 is higher than the potential at the source of the MOSFET 32. In this case, because the potential at the source of the MOSFET 32 is substantially the same as the reference potential, the MOSFET 32 is turned off. Because the MOSFET 32 is in the off-state and the diode 42 provided in parallel thereto is reverse biased, the circuit composed of the AC load 2 and the switching means 3 does not have continuity. Given that current does not flow from the MOSFET 31 side to the MOSFET 32 side through the AC load 2, power is not supplied to the AC load 2.

Consider the case where the phototransistor 59*b* of the second photocoupler 59 is turned off, and the gates of the MOSFETs 31 and 32 change to the reference potential, under conditions where the potential at the source of the MOSFET 32 is higher than the potential at the source of the MOSFET 31. In this case, because the potential at the source of the MOSFET 31 is substantially the same as the reference potential, the MOSFET 31 is turned off. Because the MOSFET 31 is in the off-state and the diode 41 provided in parallel thereto is reverse biased, the circuit composed of the AC load 2 and the switching means 3 does not have continuity. Given that current does not flow from the MOSFET 32 side to the MOSFET 31 side through the AC load 2, power is not supplied to the AC load 2. Note that the MOSFETs 31 and 32 are both also turned off and the circuit composed of the AC load 2 and the switching means 3 does not have continuity, in the case where the reference potential is applied to the gates of the MOSFETs 31 and 32, under conditions where the potential at the source of the MOSFET 31 and the potential at the source of the MOSFET 32 are equal or substantially equal. Even when the AC voltage subsequently changes, the circuit composed of the AC load 2 and the switching means 3 continues to not have continuity, and power is not supplied to the AC load 2, because the MOSFET on the low potential side remains in the off-state and the diode in parallel thereto is reverse biased.

As described above, phase control of the AC load 2 is performed by the control means 5 controlling the operation of the MOSFETs 31 and 32 of the switching means 3. In other words, a process involving power supply to the AC load 2 being stopped at a zero crossing of the AC voltage, and then, when a time period corresponding to the phase angle has elapsed after power supply has been stopped, power supply to the AC load 2 being started is repeatedly performed. For example, in the case where the phase control apparatus of the present invention is used in a bolt tightening device, power to the AC load 2, or more specifically, power to the AC motor, is phase-controlled, as a result of the AC voltage being applied to the AC load 2 at a phase angle according to a tightening torque setting that has been set by a user, such that the tightening torque is at the set value.

When phase control of the AC load 2 is performed, the potential at the gate resistors 33 and 34 of the MOSFETs 31 and 32 repeatedly changes between the supply potential and the reference potential of the constant voltage generation means 7. However, as a result of the gate resistor 33 and a gate capacitance of the MOSFET 31, which is the parasitic capacitance between the gate and source thereof, functioning as an RC delay circuit, the change in voltage at the gate of the MOSFET 31 is gradual. Also, as a result of the gate resistor 34 and a gate capacitance of the MOSFET 32, which is the parasitic capacitance between the gate and source thereof, functioning as an RC delay circuit, the change in voltage at the gate of the MOSFET 32 is gradual. The change in current flowing between the drain and source of the MOSFET 31 or 32 is thus mitigated, and electromagnetic noise arising with phase control of the AC load 2 is suppressed.

In the present embodiment, a capacitor 43 is connected between the negative output terminal of the diode bridge 71 and the gate of the MOSFET 31, and a capacitor 44 is also connected between the negative output terminal of the diode bridge 71 and the gate of the MOSFET 32. As a result of the capacitors 43 and 44, the change in voltage at these gates is more gradual. In the case where the change in current of the MOSFETs 31 and 32 can be sufficiently mitigated by appropriately providing a delay time period with the gate resistors 33 and 34 and the gate capacitances of the MOSFETs 31 and 32, these capacitors 43 and 44 need not be provided.

With the phase control apparatus of the first embodiment, as a result of configuring the constant voltage generation means 7 and devising the arrangement of the MOSFETs 31 and 32 constituting the switching means 3 as discussed above, a gate drive voltage to be applied to the gates of the MOSFETs 31 and 32 is generated, by using a simple circuit configuration that is space saving, low cost and lightweight and by full-wave rectifying the AC voltage, without including electrical components such as transformers. Further, in the case where a general commercial AC power supply is used as the AC power supply 1, the power supply line potential, or supply potential, of the constant voltage generation means 7 can be increased (e.g., +12 V) relative to a reference potential to a level necessary to drive high current MOSFETs. Hence, with the phase control apparatus of the first embodiment, MOSFETs capable of controlling high current can be used as the MOSFETs 31 and 32.

With the phase control apparatus of the first embodiment, because the AC voltage is full-wave rectified, a more stable gate drive voltage is generated, in comparison to the case where the AC voltage is half-wave rectified. Hence, power supplied to the AC load 2 every half cycle of the alternating current by phase control is more stable, in comparison to the case where the AC voltage is half-wave rectified. As a result of this power stability, erratic vibration of the motor is suppressed in the case where the AC load 2 is an AC motor, for example, and light flicker is suppressed in the case where the AC load 2 is a lighting load. Given that the supply potential of the constant voltage generation means 7 is stable, in the case where a 5 V constant voltage, for example, is required as the gate drive voltage of the MOSFETs 31 and 32, in the first embodiment, the 5 V constant voltage on the power supply line of the constant voltage generation means 7 may be used as the power supply voltage of the CPU 53 of the control means 5 or the like.

Figure 2:
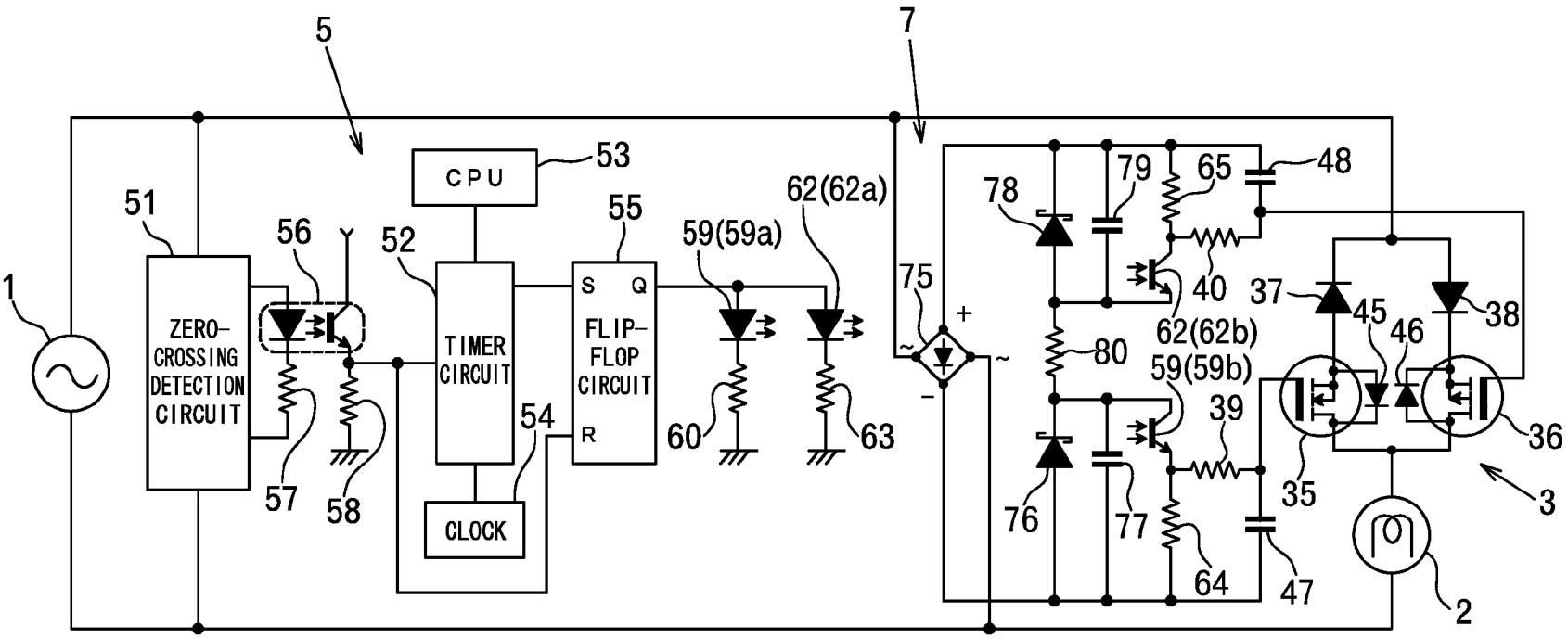
FIG. 2 is a circuit diagram showing a second embodiment of a phase control apparatus of the present invention.

FIG. 2 is a circuit diagram showing a configuration of a phase control apparatus serving as a second embodiment of the present invention. A switching means 3 arranged in series relative to an AC load 2 includes a pair of MOSFETs 35 and 36 of different polarities, that is, an N-channel MOSFET 35 and a P-channel MOSFET 36. These MOSFETs 35 and 36 are arranged in parallel, and the switching means 3 also includes a diode 37 connected in series in the forward direction with respect to the N-channel MOSFET 35, and a diode 38 connected in series in the forward direction with respect to the P-channel MOSFET 36.

More specifically, the drain of the N-channel MOSFET 35 and the drain of the P-channel MOSFET 36 are connected to one end of the AC load 2 connected to an AC power supply 1. The source of the N-channel MOSFET 35 is connected to the anode of the diode 37, and the cathode of the diode 37 is connected to one end of the AC power supply 1. The source of the P-channel MOSFET 36 is connected to the cathode of the diode 38, and the anode of the diode 38 is connected to one end of the AC power supply 1. A diode 45 that allows reverse current flow is provided between the drain and source of the N-channel MOSFET 35, and a similar diode 46 is also provided between the drain and source of the P-channel MOSFET 36. In the case where a parasitic diode of the N-channel MOSFET 35 can be utilized in place of the diode 45, the diode 45 need not be provided. The same applies to the diode 46.

A constant voltage generation means 7 of the second embodiment is characterized by generating a constant voltage that is used in control of the N-channel MOSFET 35 and a constant voltage that is used in control of the P-channel MOSFET 36 from an AC voltage. One input terminal of a diode bridge 75 included in the constant voltage generation means 7 of the second embodiment is connected to a connection point of the AC power supply 1 and the switching means 3. The other input terminal of the diode bridge 75 is connected to a connection point of the AC power supply 1 and the AC load 2. A first parallel circuit in which a first zener diode 76 and a first capacitor 77 are arranged in parallel and a second parallel circuit in which a second zener diode 78 and a second capacitor 79 are arranged in parallel are connected in series between the output terminals of the diode bridge 75, via a resistor 80. The anode of the first zener diode 76 and one end of the first capacitor 77 are connected to a negative output terminal of the diode bridge 75. The cathode of the first zener diode 76 and the other end of the first capacitor 77 are connected to one end of the resistor 80. The anode of the second zener diode 78 and one end of the second capacitor 79 are connected to the other end of the resistor 80. The cathode of the second zener diode 78 and the other end of the second capacitor 79 are connected to a positive output terminal of the diode bridge 75.

The diode bridge 75 rectifies the AC voltage, and the full-wave rectified DC voltage is applied between the output terminals of the diode bridge 75. As a result of the first zener diode 76 restricting the voltage to be applied to the first capacitor 77, and the first capacitor 77 smoothing the voltage, the potential (hereinafter, "first supply potential") at the connection point of the first parallel circuit and the resistor 80 is substantially constant relative to the potential (hereinafter, "first reference potential") at the negative output terminal of the diode bridge 75. As a result of the second zener diode 78 restricting the voltage to be applied to the second capacitor 79, and the second capacitor 79 smoothing the voltage, the potential (hereinafter, "second supply potential") at the connection point of the second parallel circuit and the resistor 80 is substantially constant relative to the potential (hereinafter, "second reference potential") at the positive output terminal of the diode bridge 75. The first supply potential is higher than the first reference potential (e.g., +12 V relative to the first reference potential), and the second supply potential is lower than the second reference potential (e.g., −12 V relative to the second reference potential).

The anode of a light-emitting diode 62*a* of a third photocoupler 62 is connected to an output terminal of a flip-flop circuit 55 of a control means 5 of the second embodiment, in addition to the anode of a light-emitting diode 59*a* of a second photocoupler 59. The cathode of this light-emitting diode 62*a* is grounded via a resistor 63. Apart from this point, the control means 5 of the second embodiment has a similar configuration to the control means 5 of the first embodiment, and thus description thereof will be omitted.

The collector of a phototransistor 59*b* of the second photocoupler 59 is connected to the connection point of the first parallel circuit and the resistor 80. A potential at this collector will be at the first supply potential. The emitter of the phototransistor 59*b* is connected to a negative output terminal of the diode bridge 75 via a resistor 64, and to the gate of the N-channel MOSFET 35 via a gate resistor 39. The emitter of a phototransistor 62*b* of the second photocoupler 62 is connected to the connection point of the second parallel circuit and the resistor 80. A potential at this emitter is at the second supply potential. The collector of the phototransistor 62*b* is connected to a positive output terminal of the diode bridge 75 via a resistor 65, and to the gate of the P-channel MOSFET 36 via a gate resistor 40.

As described in the first embodiment, when the pulse signal output from the flip-flop circuit 55 is high, the phototransistor 59*b* of the second photocoupler 59 and the phototransistor 62*b* of the second photocoupler 62 are both turned on, the gate of the N-channel MOSFET 35 changes to the first supply potential, and the gate of the P-channel MOSFET 36 changes to the second supply potential. Also, when the pulse signal output from the flip-flop circuit 55 is low, the phototransistors 59*b* and 62*b* are turned off, the gate of the N-channel MOSFET 35 changes to the first reference potential, and the gate of the P-channel MOSFET 36 changes to the second reference potential.

Consider the case where the gate of the N-channel MOSFET 35 changes to the first supply potential, and the gate of the P-channel MOSFET 36 changes to the second supply potential, under circumstances where a potential of a line (hereinafter, "upper line") connecting the AC power supply 1 and the switching means 3 is higher than a potential of a line (hereinafter, "lower line") connecting the AC power supply 1 and the AC load 2. In this case, the potential at the source of the P-channel MOSFET 36 will be substantially the same as the potential at the positive output terminal of the diode bridge 75, that is, the second reference potential. Hence, the second supply potential (difference between the second supply potential and the second reference potential; e.g., −12 V) functions as the gate drive voltage of the P-channel MOSFET 36, and the P-channel MOSFET 36 is turned on. When the P-channel MOSFET 36 is turned on, current flows from the upper line side to the lower line side through the diode 38, the drain and source of the P-channel MOSFET 36 and the AC load 2 (i.e., circuit composed of the AC load 2 and the switching means 3 has continuity), irrespective of the state of the N-channel MOSFET 35. As a result, power is supplied to the AC load 2.

Consider the case where the gate of the N-channel MOSFET 35 changes to the first supply potential, and the gate of the P-channel MOSFET 36 changes to the second supply potential, under conditions where the potential of the lower line is higher than the potential of the upper line. In this case, the potential at the source of the N-channel MOSFET 35 will be substantially the same as the potential at the negative output terminal of the diode bridge 75, that is, the first reference potential. Hence, the first supply potential (difference between the first supply potential and the first reference potential; e.g., +12 V) functions as the gate drive voltage of the N-channel MOSFET 35, and the N-channel MOSFET 35 is turned on. When the N-channel MOSFET 35 is turned on, current flows from the lower line side to the upper line side through the AC load 2, the drain and source of the N-channel MOSFET 35 and the diode 37 (i.e., circuit composed of the AC load 2 and the switching means 3 has continuity), irrespective of the state of the P-channel MOSFET 36. As a result, power is supplied to the AC load 2.

Consider the case where the gate of the N-channel MOSFET 35 changes to the first supply potential, and the gate of the P-channel MOSFET 36 changes to the second supply potential, under conditions where the potential of the upper line and the potential of the lower line are the same or substantially the same. In this case, the two MOSFETs 35 and 36 are both turned on, and the circuit composed of the AC load 2 and the switching means 3 has continuity. Subsequently, the P-channel MOSFET 36 remains in the on-state even when the potential of the upper line increases relative to the potential of the lower line, and the N-channel MOSFET 35 remains in the on-state even when the potential of the lower line increases relative to the potential of the upper line. Hence, the circuit composed of the AC load 2 and the switching means 3 continues to have continuity.

Consider the case where the gate of the N-channel MOSFET 35 is at the first reference potential, and the gate of the P-channel MOSFET 36 is at the second reference potential, under conditions where the potential of the upper line is higher than the potential of the lower line. In this case, because the potential at the source of the P-channel MOSFET 36 will be substantially the same as the second reference potential, the P-channel MOSFET 36 is turned off. Because the diode 37 is provided, the circuit composed of the AC load 2 and the switching means 3 does not have continuity when the P-channel MOSFET 36 is turned off, irrespective of the state of the N-channel MOSFET 35, and current does not flow from the upper line side to the lower line side. As a result, power is not supplied to the AC load 2.

Consider the case where the gate of the N-channel MOSFET 35 is at the first reference potential, and the gate of the P-channel MOSFET 36 is at the second reference potential, under conditions where the potential of the lower line is higher than the potential of the upper line. In this case, because the potential at the source of the N-channel MOSFET 35 will be substantially the same as the first reference potential, the N-channel MOSFET 35 is turned off. Because the diode 38 is provided, the circuit composed of the AC load 2 and the switching means 3 does not have continuity when the N-channel MOSFET 35 is turned off, irrespective of the state of the P-channel MOSFET 36, and current does not flow from the lower line side to the upper line side. As a result, power is not supplied to the AC load 2. Note that, similarly, in the case where the gate of the N-channel MOSFET 35 is at the first reference potential, and the gate of the P-channel MOSFET 36 is at the second reference potential, under conditions where the potential at the source of the upper line and the potential at the lower line are the same or substantially the same, the two MOSFETs 35 and 36 are both turned off, and the circuit composed of the AC load 2 and the switching means 3 does not have continuity. Subsequently, the P-channel MOSFET 36 remains in the off-state even when the potential of the upper line increases relative to the potential of the lower line, and the N-channel MOSFET 35 remains in the off-state even when the potential of the lower line increases relative to the potential of the upper line. As a result, the circuit composed of the AC load 2 and the switching means 3 continues to not have continuity, and power is not supplied to the AC load 2.

In the second embodiment, similarly to the first embodiment, phase control of the AC load 2 is performed by the control means 5 controlling the operations of the MOSFETs 35 and 36, as described above. When phase control of the AC load 2 is performed, the voltage applied to the gate resistor 39 of the N-channel MOSFET 35 repeatedly changes between the first supply potential and the first reference potential of the constant voltage generation means 7. However, as a result of the gate resistor 39 and a gate capacitance of the MOSFET 35, which is the parasitic capacitance between the gate and source thereof, functioning as an RC delay circuit, the change in voltage at the gate of the MOSFET 35 is gradual. The voltage applied to the gate resistor 40 of the MOSFET 36 repeatedly changes between the second supply potential and the second reference potential of the constant voltage generation means 7. However, as a result of the gate resistor 40 and a gate capacitance of the P-channel MOSFET 36, which is the parasitic capacitance between the gate and source thereof, functioning as an RC delay circuit, the change in voltage at the gate of the MOSFET 36 is gradual. The change in current flowing between the drain and source of the MOSFET 35 or 36 is thus mitigated, and electromagnetic noise arising with phase control of the AC load 2 is suppressed.

In the second embodiment, a capacitor 47 is connected between the negative output terminal of the diode bridge 75 and the gate of the N-channel MOSFET 35. A capacitor 48 is also connected between the positive output terminal of the diode bridge 75 and the gate of the P-channel MOSFET 36. In the case where the change in current of the MOSFETs 35 and 36 can be sufficiently mitigated by appropriately providing a delay time period with the gate resistors 39 and 40 and the gate capacitances of the MOSFETs 35 and 36, these capacitors 47 and 48 need not be provided.

Again, in the second embodiment, as a result of configuring the constant voltage generation means 7 and devising the arrangement of the MOSFETs 35 and 36 constituting the switching means 3 as discussed above, a gate drive voltage to be applied to the gates of the MOSFETs 35 and 36 is generated, by using a simple configuration that is low cost, space saving and lightweight and by full-wave rectifying the AC voltage, without including electrical components such as transformers. In the case where a general commercial AC power supply is used as the AC power supply 1, the gate drive voltage can be increased or decreased (e.g., +12 V or −12 V) relative to a reference potential to a level necessary to drive high current MOSFETs. Hence, in the second embodiment, MOSFETs capable of controlling high current can be used as the MOSFETs 35 and 36. Again, in the second embodiment, because the AC voltage is full-wave rectified, a more stable gate drive voltage is generated, in comparison to the case where the AC voltage is half-wave rectified.

In the first embodiment shown in FIG. 1, the N-channel MOSFETs 31 and 32 are used in the switching means 3, but P-channel MOSFETs may be used. In a third embodiment of the present invention shown in FIG. 3, the switching means 3 includes P-channel MOSFETs 31' and 32' respectively corresponding to the N-channel MOSFETs 31 and 32 of the first embodiment. Diodes 41' and 42' that allow reverse current flow are respectively provided between the drain and source of the MOSFETs 31' and 32'. In the case where a parasitic diode of the MOSFET 31' can be utilized in place of the diode 41', the diode 41' need not be provided. The same also applies to the diode 42'.

The two input terminals of a diode bridge 71' of a constant voltage generation means 7 of the third embodiment are, similarly to the first embodiment, respectively connected to a connection point of the MOSFET 31' and an AC power supply 1, and to a connection point of the MOSFET 32' and the AC power supply 1. A positive output terminal of the diode bridge 71' is connected to a parallel circuit of a capacitor 73' and a zener diode 74'. One end of the capacitor 73' and the cathode of the zener diode 74' are connected to the positive output terminal of the diode bridge 71'. The other end of the capacitor 73' and the anode of the zener diode 74' are connected to a negative output terminal of the diode bridge 71' via a resistor 72'.

In the third embodiment, a potential (hereinafter, "supply potential") at a connection point of the resistor 72' and the parallel circuit of the capacitor 73' and the zener diode 74' is a substantially constant negative value relative to a potential (hereinafter, "reference potential") at the positive output terminal of the diode bridge 71'. For example, the supply potential is −12 V relative to the reference potential.

The collector of a phototransistor **59*b* of a second photocoupler 59 of a control means 5 is connected to the positive output terminal of the diode bridge 71' via a resistor 61'. The collector of the phototransistor 59*b* of the second photocoupler 59 is connected to respective gates of the MOSFETs 31' and 32' via gate resistors 33' and 34'. Capacitors 43' and 44' are respectively connected between the positive output terminal of the diode bridge 71' and the gates of the MOSFETs 31' and 32'. As described above in the first embodiment, in the case where the gate capacitances of the MOSFETs 31' and 32' suffice, these capacitors 43' and 44' need not be provided. The emitter of the phototransistor 59*b* of the second photocoupler 59 is connected to a connection point of the resistor 72' and the parallel circuit of the capacitor 73' and the zener diode 74'**.

The control means 5 of the third embodiment has a similar configuration to the first embodiment. In the case where a pulse signal output from a flip-flop circuit 55 is high, the phototransistor **59*b* of the second photocoupler 59 is turned on. The potential at the gates of the MOSFET 31' and 32' thereby changes to the supply potential. In the case where the pulse signal output from the flip-flop circuit 55 is low, the phototransistor 59*b* of the second photocoupler 59 is turned off, and the potential at the gates of the MOSFETs 31' and 32'** changes to the reference potential.

For example, consider the case where the phototransistor **59*b* of the second photocoupler 59 is turned on, and the potential at the gate of the MOSFET 31' changes to the supply potential, under circumstances where a potential at the source of the MOSFET 31' is higher than a potential at the source of the MOSFET 32'. In this case, given that the potential at the source of the MOSFET 31' is substantially the same as the reference potential (potential at the positive output terminal of the diode bridge 71), a negative voltage (−12 V in the previous example) that is the difference between the supply potential and the reference potential of the constant voltage generation means 7 is applied to the gate of the MOSFET 31' as a gate drive voltage of the MOSFET 31'**, and the MOSFET 31' is turned on. As a result of the MOSFET 31' being turned on, current flows through the drain and source of the MOSFET 31', an AC load 2 and a diode 42' (i.e., circuit composed of the AC load 2 and the switching means 3 has continuity), irrespective of whether the MOSFET 32' is on or off, and power is supplied to the AC load 2. In the case where the phototransistor 59*b* of the second photocoupler 59 is turned off, and the potential at the gate of the MOSFET 31' changes to the reference potential, under conditions where the potential at the source of the MOSFET 31' is higher than the potential at the source of the MOSFET 32', the MOSFET 31' is turned off because the potential at the source of the MOSFET 31' is substantially the same as the reference potential. When the MOSFET 31' is in the off-state, the circuit composed of the AC load 2 and the switching means 3 does not have continuity, given that current also does not flow to the diode 41', and power is not supplied to the AC load 2.

In the case where the phototransistor 59*b* of the second photocoupler 59 is turned on, and the potential at the gates of the MOSFETs 31' and 32' changes to the supply potential of the constant voltage generation means 7, under conditions where the potential at the source of the MOSFET 31' and the potential at the source of the MOSFET 32' are equal or substantially equal, the MOSFETs 31' and 32' are both turned on, and the circuit composed of the AC load 2 and the switching means 3 has continuity. Even when the MOSFET on the low potential side is turned off following a subsequent change in the AC voltage, current flows through the diode set in parallel in that MOSFET, and the MOSFET on the high potential side remains in the on-state, so the circuit composed of the AC load 2 and the switching means 3 continues to have continuity, and power is supplied to the AC load 2.

From the above description relating to the operations of the MOSFETs 31' and 32' and the earlier description relating to the operations of the MOSFETs 31 and 32 of the first embodiment, it should be readily understood that, again, in the third embodiment, phase control of the AC load 2 is performed by the control means 5 controlling the operations of the MOSFETs 31' and 32' of the switching means 3.

Figure 4:
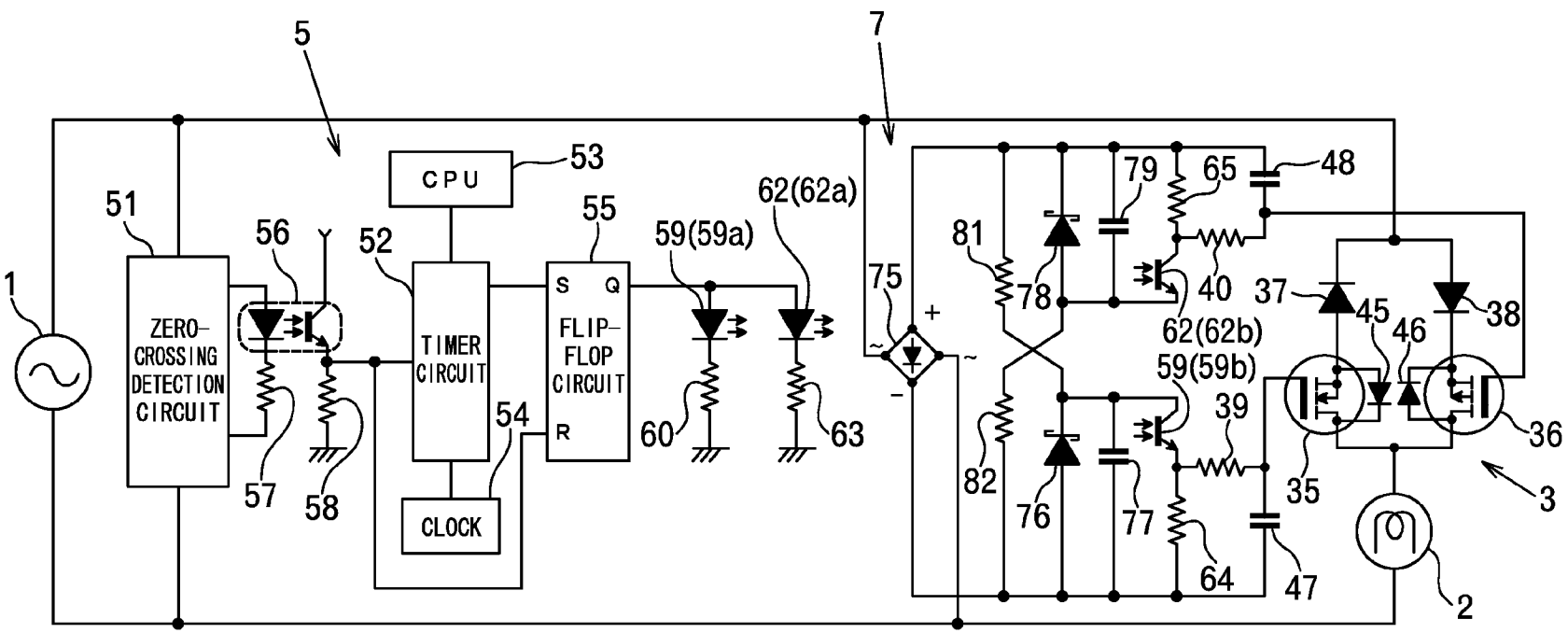
FIG. 4 is a circuit diagram showing a fourth embodiment of a phase control apparatus of the present invention.

FIG. 4 is a circuit diagram showing a configuration of a phase control apparatus serving as a fourth embodiment of the present invention. In the fourth embodiment, a first resistor 81 and a second resistor 82 are provided in place of the resistor 80 in the second embodiment. One end of the first resistor 81 is connected to the cathode of a first zener diode 76 and one end of a first capacitor 77. One end of the second resistor 82 is connected to the anode of a second zener diode 78 and one end of a second capacitor 79. The other end of the second resistor 82 is connected to a negative output terminal of a diode bridge 75. The other end of the first resistor 81 is connected to a positive output terminal of the diode bridge 75.

Apart from the changes relating to the first resistor 81 and the second resistor 82, the fourth embodiment is configured similarly to the second embodiment. From the earlier description relating to the second embodiment, it should be readily understood that, again, in the fourth embodiment, phase control of the AC load 2 is performed by a control means 5 controlling the operations of the MOSFETs 35 and 36 of a switching means 3.

Figure 3:
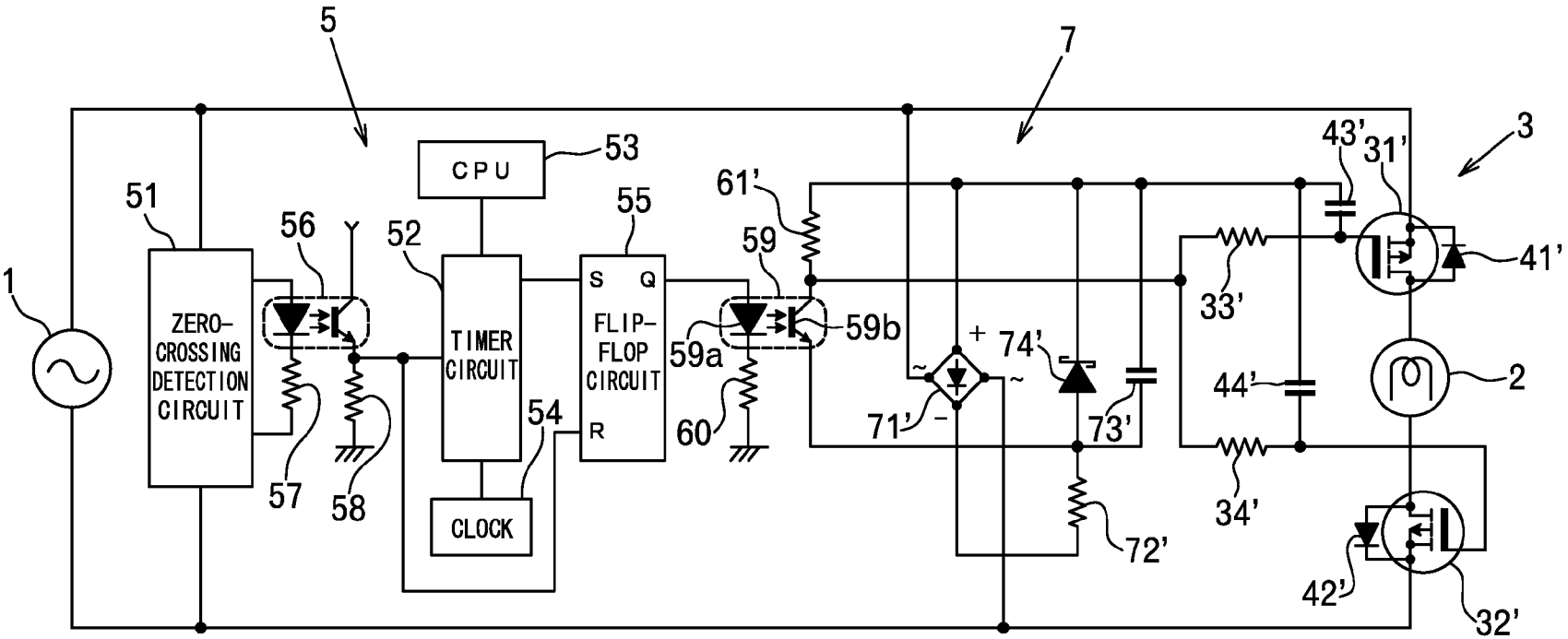
FIG. 3 is a circuit diagram showing a third embodiment of a phase control apparatus of the present invention.

The phase control apparatuses of the first to fourth embodiments operate with positive logic, but may be changed so as to operate with negative logic. In the case where the first embodiment shown in FIG. 1 is changed to operate with negative logic, the resistor 61 shown in FIG. 1 (and the capacitors 43 and 44) moves to the collector side of the phototransistor 59*b* of the second photocoupler 59, and the gates of the MOSFETs 31 and 32 are connected to the collector of the phototransistor 59*b* via the gate resistors 33 and 34. In other words, the gates of the MOSFETs 31 and 32 are connected to the collector of the phototransistor 59*b*, as with the gates of the MOSFETs 31' and 32' in the third embodiment of FIG. 3. Further, the control means 5 of the first embodiment is changed so as to operate with negative logic. For example, the first photocoupler 56 is turned on, and when the zero-crossing detection circuit 51 detects a zero crossing of the AC voltage of the AC power supply 1, the first photocoupler 56 is briefly turned off. In the case where the third embodiment shown in FIG. 3 is changed so as to operate with negative logic, the gates of the MOSFETs 31' and 32' are connected to the emitter of the phototransistor 59*b*, as with the gates of the MOSFETs 31 and 32 in the first embodiment of FIG. 1, and the control means 5 is changed so as to operate with negative logic.

In the case where the second embodiment shown in FIG. 2 and the fourth embodiment shown in FIG. 4 are changed so as to operate with negative logic, the resistor 64 (and the capacitor 47) moves to the collector side of the phototransistor 59*b* of the second photocoupler 59, and the gate of the MOSFET 35 is connected to the collector of the phototransistor 59*b* via the gate resistor 39. Further, the resistor 65 (and the capacitor 48) moves to the emitter side of the phototransistor 62*b* of the third photocoupler 62, and the gate of the MOSFET 36 is connected to the emitter of the phototransistor 62*b* via the gate resistor 40. Further, the control means 5 is changed so as to operate with negative logic.

With the phase control apparatuses of the first to fourth embodiments, power to the AC load 2 is phase-controlled, but the phase control apparatuses of the first to fourth embodiments can be readily changed such that reverse phase control of power to the AC load 2 is performed. In the first embodiment, in the case where power to the AC load 2 is reverse phase-controlled, an inverter can be arranged between the output terminal of the flip-flop circuit 55 and the second photocoupler 59, for example (the same also applies to the third embodiment). In the second embodiment, in the case where power to the AC load 2 is reverse phase-controlled, an inverter can be arranged between the output terminal of the flip-flop circuit 55 and the second and third photocouplers 59 and 62, for example (the same also applies to the fourth embodiment). Note that reverse phase control may also be performed by making changes to accommodate negative logic such as mentioned above, in the first to fourth embodiments, without adding an inverter.

The N-channel MOSFETs 31 and 32 are used in the switching means 3 of the first embodiment, and the P-channel MOSFETs 31' and 32' are used in the switching means 3 of the third embodiment, but transistors such as IGBTs or bipolar transistors may be used in place of these MOSFETs. For example, in the case where the MOSFETs 31 and 32 of the first embodiment are both replaced by IGBTs, the collectors of these IGBTs are connected to the AC load 2, and the emitters of these IGBTs are connected to the AC power supply 1. In the case where the MOSFETs 31 and 32 of the first embodiment are both replaced by bipolar transistors, the collectors of these bipolar transistors are connected to the AC load 2, the emitters of these bipolar transistors are connected to the AC power supply 1, and the bases of these bipolar transistors are connected to the emitter of the phototransistor 59*b* of the second photocoupler 59 via the resistors 33 and 34. Also, in the second and fourth embodiments, the N-channel MOSFET 35 and the P-channel MOSFET 36 are used in the switching means 3, but an N-channel IGBT and a P-channel IGBT or an NPN transistor and an PNP transistor may be used in place of these MOSFETs.

In the first to fourth embodiments, the second photocoupler 59 and also the third photocoupler 62 are used in the control means 5, and the phototransistors 59*b* and 62*b* functioning as switching elements are used on the light-receiving side of these photocouplers 59 and 62, but switching elements such as photothyristors or photo MOSFETs may be used on the light-receiving side of the photocouplers 59 and 62. Also, a switching element such as a normal bipolar transistor or MOSFET may be used in place of the second photocoupler 59 or the third photocoupler 62, and this switching element may be directly driven with an output signal of the flip-flop circuit 55.

The foregoing description of the embodiments is intended to illustrate the present invention, and should not be construed as limiting the invention defined in the claims or as restricting the scope of the invention. The configuration of each part of the invention is not limited to the foregoing embodiments, and modifications are possible within the scope of the invention defined in the claims.

What is claimed is:

1. A phase control apparatus for performing phase-control or reverse phase control of power that is supplied to a load connected to an alternating current power supply, comprising:

a first transistor whose source or emitter is connected to one end of the alternating current power supply, and whose drain or collector is connected to one end of the load;

a second transistor whose source or emitter is connected to the other end of the alternating current power supply, and whose drain or collector is connected to the other end of the load;

a diode bridge that rectifies an alternating current voltage of the alternating current power supply; and a parallel circuit of a zener diode and a capacitor, wherein the parallel circuit generates a high potential relative to a potential at a negative output terminal of the diode bridge, or generates a low potential relative to a potential at a positive output terminal of the diode bridge, using an output of the diode bridge, and a potential at a control terminal of the first transistor and a potential at a control terminal of the second transistor are switched between the high potential and the potential at the negative output terminal of the diode bridge or between the low potential and the potential at the positive output terminal of the diode bridge.

2. The phase control apparatus according to claim 1, further comprising a resistor, wherein one end of the resistor is connected to the positive output terminal of the diode bridge, the other end of the resistor is connected to a cathode of the zener diode and one end of the capacitor, and an anode of the zener diode and the other end of the capacitor are connected to the negative output terminal of the diode bridge, one input terminal of the diode bridge is connected to a connection point of the alternating current power supply and the first transistor, and the other input terminal of the diode bridge is connected to a connection point of the alternating current power supply and the second transistor, and the potential at the control terminal of the first transistor and the potential at the control terminal of the second transistor are switched between a potential at a connection point of the resistor and the parallel circuit and the potential at the negative output terminal of the diode bridge.

3. The phase control apparatus according to claim 2, further comprising a switching element, wherein the control terminal of the first transistor and the control terminal of the second transistor are each connected to one end of the switching element via a gate resistor, and a potential at one end of the switching element switches between the potential at the connection point of the resistor and the parallel circuit and the potential at the negative output terminal of the diode bridge, according to an on/off state of the switching element.

4. The phase control apparatus according to claim 1, further comprising a resistor, wherein one end of the resistor is connected to the negative output terminal of the diode bridge, the other end of the resistor is connected to an anode of the zener diode and one end of the capacitor, and a cathode of the zener diode and the other end of the capacitor are connected to the positive output terminal of the diode bridge, one input terminal of the diode bridge is connected to a connection point of the alternating current power supply and the first transistor, and the other input terminal of the diode bridge is connected to a connection point of the alternating current power supply and the second transistor, and the potential at the control terminal of the first transistor and the potential at the control terminal of the second transistor are switched between a potential at the connection point of the resistor and the parallel circuit and a potential at the positive output terminal of the diode bridge.

5. The phase control apparatus according to claim 4, further comprising a switching element, wherein the control terminal of the first transistor and the control terminal of the second transistor are each connected to one end of the switching element via a gate resistor, and a potential at one end of the switching element switches between the potential at the connection point of the resistor and the parallel circuit and the potential at the positive output terminal of the diode bridge, according to an on/off state of the switching element.

6. A phase control apparatus for performing phase-control or reverse phase control of power that is supplied to a load connected to an alternating current power supply, using a switching means provided in series with the load, comprising:

a diode bridge that rectifies an alternating current voltage of the alternating current power supply;

a first parallel circuit of a first zener diode and a first capacitor for generating a high potential relative to a potential at a negative output terminal of the diode bridge, using an output of the diode bridge; and a second parallel circuit of a second zener diode and a second capacitor for generating a low potential relative to a potential at a positive output terminal of the diode bridge, using the output of the diode bridge, wherein the switching means includes:

a first transistor provided between the alternating current power supply and the load;

a second transistor of different polarity to the first transistor and arranged in parallel with the first transistor;

a first diode connected in series in the forward direction with respect to the first transistor; and a second diode connected in series in the forward direction with respect to the second transistor, a source or an emitter of the first transistor and a source or an emitter of the second transistor are arranged on the alternating current power supply side, and a potential at a control terminal of the first transistor is switched between the high potential and the potential at the negative output terminal of the diode bridge, and a potential at a control terminal of the second transistor is switched between the low potential and the potential at the positive output terminal of the diode bridge.

7. The phase control apparatus according to claim 6, further comprising a resistor, wherein one end of the resistor is connected to a cathode of the first zener diode and one end of the first capacitor, the other end of the resistor is connected to an anode of the second zener diode and one end of the second capacitor, an anode of the first zener diode and the other end of the first capacitor are connected to the negative output terminal of the diode bridge, and a cathode of the second zener diode and the other end of the second capacitor are connected to the positive output terminal of the diode bridge, one input terminal of the diode bridge is connected to a connection point of the alternating current power supply and the switching means, and the other input terminal of the diode bridge is connected to a connection point of the alternating current power supply and the load, and the potential at the control terminal of the first transistor is switched between a potential at a connection point of the resistor and the first parallel circuit and the potential at the negative output terminal of the diode bridge, and the potential at the control terminal of the second transistor is switched between a potential at a connection point of the resistor and the second parallel circuit and the potential at the positive output terminal of the diode bridge.

8. The phase control apparatus according to claim 7, further comprising a first switching element and a second switching element, wherein the control terminal of the first transistor is connected to one end of the first switching element via a gate resistor, a potential at one end of the first switching element switches between the potential at the connection point of the resistor and the first parallel circuit and the potential at the negative output terminal of the diode bridge, according to an on/off state of the first switching element, the control terminal of the second transistor is connected to one end of the second switching element via a gate resistor, and a potential at one end of the second switching element switches between the potential at the connection point of the resistor and the second parallel circuit and the potential at the positive output terminal of the diode bridge, according to an on/off state of the second switching element.

9. The phase control apparatus according to claim 6, further comprising a first resistor and a second resistor, wherein one end of the first resistor is connected to a cathode of the first zener diode and one end of the first capacitor, one end of the second resistor is connected to an anode of the second zener diode and one end of the second capacitor, the other end of second resistor, an anode of the first zener diode and the other end of the first capacitor are connected to the negative output terminal of the diode bridge, and the other end of first resistor, a cathode of the second zener diode and the other end of the second capacitor are connected to the positive output terminal of the diode bridge, one input terminal of the diode bridge is connected to a connection point of the alternating current power supply and the switching means, and the other input terminal of the diode bridge is connected to a connection point of the alternating current power supply and the load, and the potential at the control terminal of the first transistor is switched between a potential at a connection point of the first resistor and the first parallel circuit and the potential at the negative output terminal of the diode bridge, and the potential at the control terminal of the second transistor is switched between a potential at a connection point of the second resistor and the second parallel circuit and the potential at the positive output terminal of the diode bridge.

10. The phase control apparatus according to claim 9, further comprising a first switching element and a second switching element, wherein the control terminal of the first transistor is connected to one end of the first switching element via a gate resistor, a potential at one end of the first switching element switches between the potential at the connection point of the first resistor and the first parallel circuit and the potential at the negative output terminal of the diode bridge, according to an on/off state of the first switching element, the control terminal of the second transistor is connected to one end of the second switching element via a gate resistor, and a potential at one end of the second switching element switches between the potential at the connection point of the second resistor and the second parallel circuit and the potential at the positive output terminal of the diode bridge, according to an on/off state of the second switching element.

* * * * *